US007373927B2

(12) United States Patent
Vorbach

(10) Patent No.: US 7,373,927 B2
(45) Date of Patent: May 20, 2008

(54) METHOD FOR OPERATING AN INTERNAL COMBUSTION ENGINE

(75) Inventor: Marco Vorbach, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 338 days.

(21) Appl. No.: 10/524,602

(22) PCT Filed: Jul. 2, 2003

(86) PCT No.: PCT/DE03/02212

§ 371 (c)(1),
(2), (4) Date: Jul. 21, 2005

(87) PCT Pub. No.: WO2004/018859

PCT Pub. Date: Mar. 4, 2004

(65) Prior Publication Data

US 2006/0118092 A1 Jun. 8, 2006

(30) Foreign Application Priority Data

Aug. 16, 2002 (DE) ..... 102 37 408

(51) Int. Cl.
*F02M 51/00* (2006.01)

(52) U.S. Cl. ..... 123/490; 123/472; 239/102.2

(58) Field of Classification Search ..... 123/467, 123/458, 472, 198 D, 299, 300, 490; 310/316.01, 310/317; 239/102.2; 251/129.06
See application file for complete search history.

(56) References Cited

U.S. PATENT DOCUMENTS 3,803,424 A * 4/1974 Smiley et al. ..... 307/149
4,726,389 A * 2/1988 Minoura et al. ..... 137/1
5,025,766 A * 6/1991 Yamauchi et al. ..... 123/472
6,253,736 B1 * 7/2001 Crofts et al. ..... 123/498
6,420,817 B1 * 7/2002 Ricci-Ottati et al. ... 310/316.01
6,732,715 B2 * 5/2004 Fallahi et al. ..... 123/480
6,760,212 B2 * 7/2004 Cheever et al. ..... 361/160
6,772,735 B2 * 8/2004 Boss et al. ..... 123/467
6,990,855 B2 * 1/2006 Tuken et al. ..... 73/118.1
7,185,828 B2 * 3/2007 Igashira et al. ..... 239/88
2001/0027780 A1 * 10/2001 Rueger et al. ..... 123/498
2003/0150429 A1 * 8/2003 Rueger ..... 123/490

FOREIGN PATENT DOCUMENTS

DE 39 35 937 5/1990
DE 100 39 418 2/2002

* cited by examiner

*Primary Examiner*—Carl S. Miller
(74) *Attorney, Agent, or Firm*—Kenyon & Kenyon LLP

(57) ABSTRACT

A method for operating an internal combustion engine in which a valve needle of a fuel injector is adjusted from a closing position via an intermediate position to an opening position and back again. The adjustment is carried out with the aid of a piezoelectric actuator to which a trigger signal is applied. To reduce the contamination danger of the fuel injector and to keep wear of the valve needle low, the trigger signal for triggering the piezoelectric actuator has a greater slope steepness during the transition of the valve needle from the closing position to the intermediate position than during the transition of the valve needle from the intermediate position to the opening position.

8 Claims, 1 Drawing Sheet

METHOD FOR OPERATING AN INTERNAL COMBUSTION ENGINE

FIELD OF THE INVENTION

The present invention relates to a control device and a method for operating an internal combustion engine in which a valve needle of a fuel injector is adjusted from a closing position via an intermediate position to an opening position and back, with the aid of a piezoelectric actuator to which a trigger signal is applied.

BACKGROUND INFORMATION

Conventional operating methods and control devices for such a method may be disadvantageous in that, on the one hand, they may lead to an increased contamination risk of the fuel injector and, on the other hand, they may prevent a controlled closing of the fuel injector.

The increased contamination risk is due to the fact that the fuel injector is in a state of a comparatively low lift of the injection needle, and thus reduced opening of the fuel injector, for a relatively long period of time. The danger that particles get jammed between the valve orifice and the valve needle and clog the valve orifice is especially great in this state.

A greater slope steepness of the trigger signal leads to greater velocity of the valve needle in the transition from the opening to the closing position and vice versa, but, due to the high velocity of the valve needle, so-called needle bouncers occur when the valve needle hits the valve seat, which cause the fuel injector to open in an uncontrolled manner after reaching the closing position. Furthermore, overswingers of the valve needle may occur.

SUMMARY

It is an object of the present invention to improve an operating method and a control device of the type mentioned in the introduction to the extent that the contamination risk of the fuel injector is reduced and the valve needle is adjusted, or is able to be adjusted, into the opening and closing position in a controlled manner.

In accordance with an example embodiment of the present invention, this object may be achieved if, for example, the trigger signal has a greater slope steepness in the transition of the valve needle from the closing position to the intermediate position than in the transition of the valve needle from the intermediate position to the opening position.

The relatively high slope steepness of the trigger signal for the piezoelectric actuator during the transition of the valve needle from the closing position to the intermediate position effects a rapid readjustment of the valve needle out of the closing position into the intermediate position, so that the period during which the fuel injector has a low needle lift is relatively brief, thereby reducing the likelihood of valve contamination or clogging due to jammed particles.

Accordingly, the relatively low slope steepness of the trigger signal for the piezoelectric actuator leads to a controlled reaching of the opening position by the valve needle during the transition of the valve needle from the intermediate position to the opening position, in which the valve needle, in particular, does not bounce so that no uncontrolled adjustment of the valve needle takes place in the opening position.

According to one advantageous embodiment of the present invention, the trigger signal has a greater slope steepness during the transition of the valve needle from the opening position to the intermediate position than during the transition of the valve needle from the intermediate position to the closing position. As a result, analogously to the opening procedure of the fuel injector, the same advantages are derived regarding the duration of the opening period of the fuel injector at low needle lift, or regarding the controlled attainment of the closing position by the valve needle.

In particular, the valve needle does not bounce off the valve seat due to the relatively low slope steepness of the trigger signal during the transition of the valve needle from the intermediate position to the closing position, so that no uncontrolled opening of the fuel injector occurs after the valve needle has reached the closing position.

In accordance with another advantageous embodiment of the present invention, during the transition of the valve needle from the opening position to the closing position, the trigger signal is symmetrical to the trigger signal during the transition of the valve needle from the closing position to the opening position.

Due to the symmetry, the triggering of the piezoelectric actuator is considerably simplified since the signal form of the trigger signal must be stored only for a transition of the valve needle, i.e., either for the transition of the valve needle from the closing position to the opening position or vice versa. The respective other trigger signal may be generated by subtraction of the stored signal values of the trigger signal from a maximum signal value for the trigger signal or the like, for instance. This is possible both in an analog and a digital triggering of the piezoelectric actuator.

As an additional embodiment of the present invention, a computer program for a control device of an internal combustion engine is provided in which a valve needle of a fuel injector is adjusted from a closing position via an intermediate position to an opening position and back by means of a piezoelectric actuator to which a trigger signal is applied, the computer program being suited for implementing the example method according to the present invention.

Exceedingly advantageous is another variant of the present invention in which the computer program is stored on an electric storage medium, in particular a flash memory or a read-only memory.

Yet another advantage may be achieved by providing a control device for an internal combustion engine.

Further features, uses and advantages of the present invention come to light from the following description of exemplary embodiments of the present invention, which are shown in the figures of the drawing. In this context, all of the described or represented features, alone or in any combination, constitute the subject matter of the present invention, regardless of their formulation and representation in the specification and the drawings.

DETAILED DESCRIPTION OF EXAMPLE EMBODIMENTS

Figure 1:
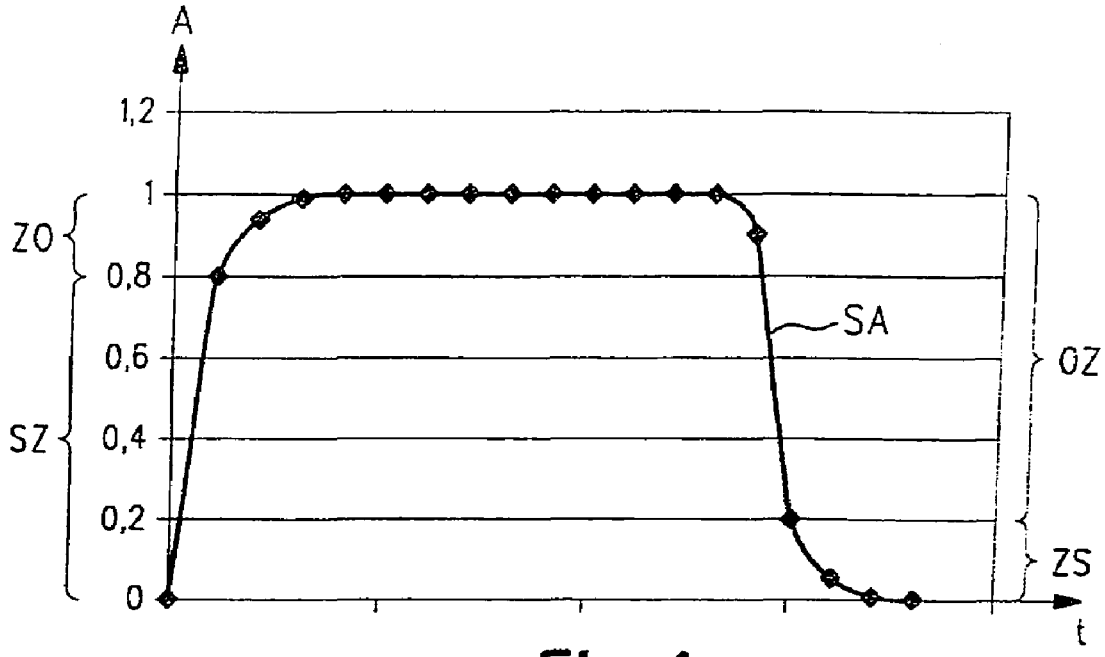
FIG. 1 shows a time characteristic of a trigger signal according to the present invention.

Trigger signal SA shown in FIG. 1 is utilized in an internal combustion engine (not shown) to trigger a piezoelectric actuator, which adjusts a valve needle of an injection valve of the internal combustion engine from a closing position via an intermediate position to an opening position and back.

In the diagram of FIG. 1, t denotes the time axis and A a value of trigger signal SA standardized to the maximum value of trigger signal SA. Trigger signal SA is an analog signal.

For the further elucidation of the method according to the present invention, a plurality of regions SZ, Z0, 0Z, ZS of trigger signal SA are marked in the diagram of FIG. 1, which are described in the following.

At the beginning of an injection, the piezoelectric actuator (not shown) is triggered by a control device of the internal combustion engine by the portion of trigger signal SA lying in region SZ in which trigger signal SA has a relatively great slope steepness. This may ensure that the valve needle of the fuel injector is rapidly adjusted from the closing position, which corresponds to a zero value of trigger signal SA, into the intermediate position, so that states of low needle lift and thus a clogging risk caused by jammed particles are avoided.

Subsequently, the piezoelectric actuator is triggered during the transition from the intermediate position to the opening position, which corresponds to a value one of trigger signal SA, by a trigger signal SA having relatively low slope steepness, thereby defining region Z0 of trigger signal SA. The low slope steepness of trigger signal SA in region Z0 has the effect that the valve needle is not too fast when it reaches the opening position and will not move out of the attained opening position again in an uncontrolled manner due to bouncing, or will open in an uncontrolled manner due to overswinging. Subsequently, trigger signal SA is maintained at its maximum value of one for a certain period of time.

As shown in FIG. 1, trigger signal SA initially traverses region OZ during the closing procedure, the valve needle of the fuel injector being adjusted from the opening position to the intermediate position. Here, the slope steepness of trigger signal SA is relatively high again so as to reduce the already mentioned danger of valve contamination.

At the end of the injection phase, which corresponds to region ZS of trigger signal SA, trigger signal SA once again has a relatively low slope steepness in order to prevent valve needle from hitting the valve seat of the fuel injector too rapidly, and thus to avoid bouncing of the valve needle, which leads to uncontrolled openings of the fuel injector.

In this way it is possible to reduce the risk of valve contamination and simultaneously achieve a controlled opening and closing of the fuel injector.

Figure 2:
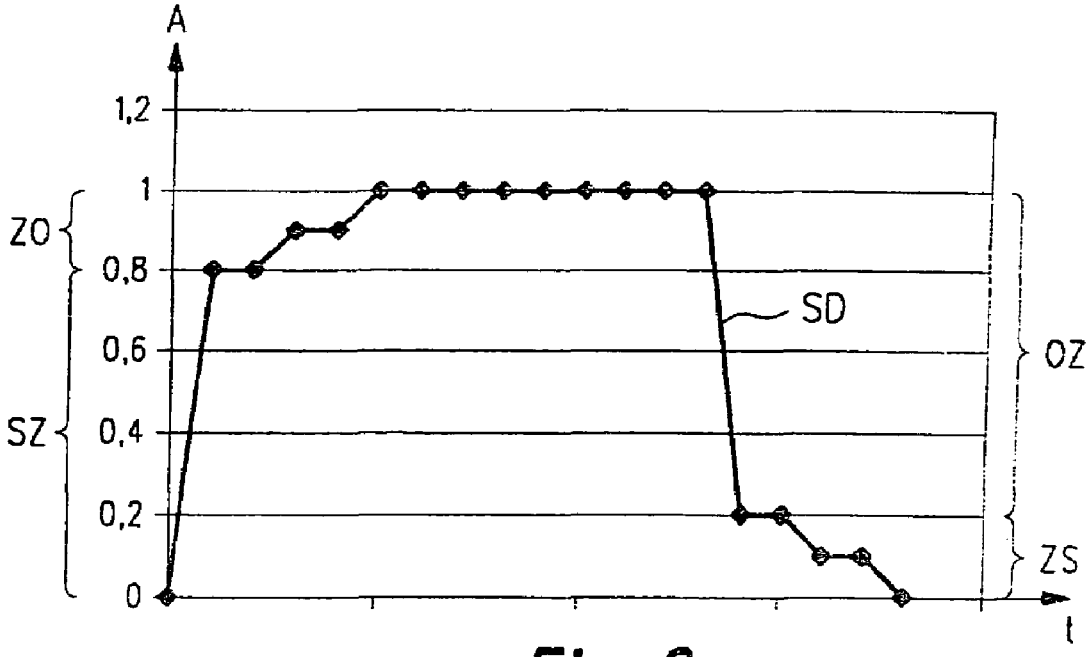
FIG. 2 shows a time characteristic of another trigger signal according to the present invention.

It is also possible to implement the triggering of the piezoelectric actuator by a digital signal. To this end, FIG. 2 shows a corresponding diagram in which the time characteristic of digital trigger signal SD is indicated. The functioning method is identical to the triggering of the piezoelectric actuator by the analog trigger signal SA.

Since the time for adjusting the valve needle from the opening position to the closing position is determined nearly exclusively by the kinematics of a system made up of the valve needle and a spring mechanically acting upon the valve needle with an initial stress, it is advantageous to consider the mechanical parameters of the system valve needle/spring in the selection of the signal form of trigger signal SA or SD so as to achieve an optimal division of the valve travel having high/low slope steepness.

Particularly advantageous is also a symmetry between the signal form of trigger signal SA, SD, which is used in the adjustment of the valve needle from the closing position to the opening position, and the signal form of trigger signal SA, SD, which is utilized in the adjustment of the valve needle from the opening position to the closing position. In this case, it is possible to store only one signal form, for example in a memory of the control device, and to generate the respective other signal form from the stored signal form.

The afore-described method may be realized as computer program, which is able to run on the control device and is stored in its memory.

In general, the example method according to the present invention may be used in metering systems having components that are driven by piezoelectric actuators.

What is claimed is:

1. A method for operating an internal combustion engine, comprising:

moving a valve needle of a fuel injector from a closing position via an intermediate position to an opening position and back using a piezoelectric actuator to which a trigger signal is applied; and forming the trigger signal with a greater slope steepness during a transition of the valve needle from the closing position to the intermediate position than during a transition of the valve needle from the intermediate position to the opening position;

wherein the trigger signal, during the transition of the valve needle from the opening position to the closing position, is symmetrical to the trigger signal during the transition of the valve needle from the closing position to the opening position.

2. The method as recited in claim 1, wherein the trigger signal is formed to have a greater slope steepness during the transition of the valve needle from the opening position to the intermediate position than during the transition of the valve needle from the intermediate position to the closing position.

3. A memory device storing a computer program on a computer readable medium for a control device of an internal combustion engine, the computer program, when executed by the control device, causing the control device to perform the steps of:

moving a valve needle of a fuel injector from a closing position via an intermediate position to an opening position and back using a piezoelectric actuator to which a trigger signal is applied; and forming the trigger signal with a greater slope steepness during a transition of the valve needle from the closing position to the intermediate position than during a transition of the valve needle from the intermediate position to the opening position;

wherein the trigger signal, during the transition of the valve needle from the opening position to the closing position, is symmetrical to the trigger signal during the transition of the valve needle from the closing position to the opening position.

4. The memory device as recited in claim 3, wherein the memory device is an electric memory medium.

5. The memory device according to claim 4, wherein the electric memory medium is a flash medium.

6. The memory device according to claim 4, wherein the electric memory medium is a read-only memory.

7. A control device for an internal combustion engine, comprising:

an arrangement configured to move a valve needle of a fuel injector from a closing position via an intermediate position to an opening position and back using a piezoelectric actuator to which a trigger signal is applied; and an arrangement configured to form the trigger signal, the trigger signal having a greater slope steepness during a transition of the valve needle from the closing position than during a transition of the valve needle from the intermediate position to the opening position;

wherein the trigger signal, during the transition of the valve needle from the opening position to the closing position, is symmetrical to the trigger signal during the transition of the valve needle from the closing position to the opening position.

8. The control device as recited in claim 7, wherein the trigger signal has a greater slope steepness during the transition of the valve needle from the opening position to the intermediate position than during the transition of the valve needle from the intermediate position to the closing position.

* * * * *